US006322403B1

(12) United States Patent
Lok et al.

(10) Patent No.: US 6,322,403 B1
(45) Date of Patent: Nov. 27, 2001

(54) LOW INSERTION FORCE MATING ELECTRICAL CONTACT STRUCTURE

(75) Inventors: Gordon Lok, La Habra; Craig Li, Carson, both of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/597,860

(22) Filed: Jun. 20, 2000

(51) Int. Cl.[7] ..... H01R 13/11
(52) U.S. Cl. ..... 439/856
(58) Field of Search ..... 439/856, 857, 439/858, 861, 862

(56) References Cited

U.S. PATENT DOCUMENTS 4,175,821 * 11/1979 Hunter .
4,607,907 * 8/1986 Bogursky .
4,740,180 * 4/1988 Harwath et al. ..... 439/856
5,290,181 * 3/1994 Bixler et al. ..... 439/866

* cited by examiner

*Primary Examiner*—Gary Paumen
(74) *Attorney, Agent, or Firm*—Wei Te Chung

(57) ABSTRACT

A mating pair of low insert ion force contacts comprises a female contact device and a male contact matingly engaged with each other. The female contact device comprises a first arm and a second arm insert molded in a dielectric housing. The first arm and the second arm respectively have a first spring contact portion and a second spring contact portion extending out from a front face of the dielectric housing. The first arm has a tail portion extending out from a rear face of the dielectric housing, and the first arm and the second arm are split with each other. A male contact has a slant head connected to two oppositely protruded snaps which are connected to a slant section coplanar with the slant head. The male contact may be engaged with the female contact device by moving the slant head of the male contact into a space between the first spring contact portion and the second spring contact portion and driving the oppositely protruded snaps to respectively wipe against the first spring contact portion and the second spring contact portion.

1 Claim, 5 Drawing Sheets

LOW INSERTION FORCE MATING ELECTRICAL CONTACT STRUCTURE

BACKGROUND OF THE INVENTION

1. Field of The Invention

The present invention relates to the mating contacts used in electrical connectors and, more particularly, to a low insertion force, high contact normal force, mating male and female electrical contact structure.

2. The Prior Art

Metal pins have been used in the electrical connector industry for making electrical contact between a plug connector and a receptacle connector. Various single and dual spring arm female contact electrical terminals have been provided in the past for making electrical contact with male terminals such as pins, blades, edge card contact pads and the like. In order to establish satisfactory electrical connection, one of the terminals must exert sufficient pressure on the other resulting in a minimum contact normal force being exerted when the terminals are in a final mated position. However, this pressure causes frictional drag during insertion and removal, therefore, the male terminal must be inserted into the female terminal with sufficient force to overcome the resistance to insertion presented by the female terminal. In addition, the insertion force of the contact structure must include a lifting component which represents the force required to lift or spread the female contact portions apart to permit insertion of the male terminal into the female terminal as well as the horizontal frictional component which is a result of the female contact portions wiping against the meal terminal during the insertion As a result, in multi-circuit arrangements including a large number of female terminals mounted in a connector adapted to mate with a male connector having a correspondingly large number of male terminals, the individual insertion forces associated with each pair of terminals combine so that the overall insertion force required to mate the male and female connectors may be extremely large.

Earlier efforts to provide an electrical contact structure characterized by reduced insertion force have generally included modifying the female terminal or contacts. In U.S. Pat. No. 4,175,821, for example, a female terminal is disclosed which includes a dual opposed spring arm contact member wherein the contact portions of the opposed arms are axially offset from one another in the longitudinal direction. As a male pin contact is inserted between the female spring arms, the male pin engages the first spring arm on the female terminal and lifts it out of the way, before contacting the second spring arm and moving that contact of the way. AS a result, a lower peak insertion force is achieved because the male terminal lifts only one female spring arm at a time instead of two at a time. The design of this patent has several shortcomings. For example, the female terminal is adapted to receive a conventional square pin male terminal which includes a relatively short, chamfered tip portions. The tip portion of the male terminal typically is a rough machined surface which wipes against the precious metal plated contact portion on the female terminal. Repeated mating results in abraded contacts which tends to make the contact arrangement electrically unreliable in prolonged use. Increasing the precious metal plating in the contact area results in increased cost which is undesirable.

Another modified low insertion force female terminal is disclosed in U.S. Pat. No. 4,607,907 at their free ends. The female contact in this patent is a stamped and formed terminal which includes a rearward box-like member from which extend cantilevered spring arms having contact portions at their free ends. The contact portions are axially longitudinally offset similar to the contact portions in the aforementioned patent, but, in addition, they are configured so that they overshoot the midline of the insertion region which permits lower spring rates to be used. The female contact further includes horizontal spacing between the cantilevered spring arms so that the contact portions are horizontally spaced one from the other. This permits the contact portions to be plated with precious metals in a lower cost process. This female contact provides a lower peak insertion force for the same reasons, i.e. the male lifts one cantilevered spring arm at a time during insertion. The overshot design of the contact portions permits lower spring rates in the spring members to be used, so that the stiffness of each spring member is reduced and the force required to lift each spring arm contact during pin insertion is reduced.

This design also possesses several shortcomings. As with the first mentioned female terminal, the rough cut abrasive edge of the chamfered lead-in on the male pin scrapes against the precious metal coated contact portions of the spring arms during pin insertion. Long term electrical reliability in repeated mating operations is generally not obtained. The female terminal is stamped and then formed in a manner which produces a significantly large amount of wasted sheet metal stock. Furthermore, because these female terminals are formed after stamping to provide the box portion and opposed spring arm structure, they cannot be provided on a carrier strip spaced apart by centerline spacingly adapted for ready insertion in a connector housing in a single stamping operation. Instead, after they are formed, they must be repositioned to a spacing appropriate for insertion into a housing. This requires additional manufacturing and assembly steps in use.

Also another low insertion force mating contact structure is disclosed in U.S. Patent No. 4,740,180 having a male terminal and a female terminal. The male terminal is an elongate conductor having at least one surface extending the length thereof and including a final contact portion joining a forwardly extending lead-in portion which has a gradual twisted cross-section relative to the final contact portion. The female terminal includes at least one spring arm with a contact portion adapted to electrically engage the surface of the male terminal. The spring contact portion slidingly engages the surface in the lead-in portion being effective to increasingly deflect the contact portion of the spring arm as the male terminal is inserted from initial position to a final position when the female contact portion is on the final contact position of the male terminal. The normal force between the contact portion of the spring arm on the surface of the male terminal gradually increases as the male terminal is inserted into the female terminal until a final mated position is achieved.

This mating contact structure works well for large size connector which allows the insertion length to be long enough for separating the contact terminal into a lead-in twisted portion and a final contact portion, yet it does not meet the compact size requirement, wherein the contact terminal length is limited for meeting the compact size trend in the connector industry.

Further another low insertion force male contact is disclosed in U.S. Pat. No. 5,290,181 at its laterally offset, symmetrical diverging beams. This split male contact although can reduce insertion force due to the flexibility of the split beams, it is apt to deform permanently at its split beams. In other words, the split beams are apt to loose their flexibility after long term use. This kind of male contact will have larger and larger insertion force with respect to a complementary female contact after repeated insertion/withdrawal therewith.

It is requisite to provide a new male contact to solve the above problems.

SUMMARY OF THE INVENTION

The primary purpose of the present invention is to provide a new electrical low insertion force mating contact structure having a male contact and a female contact which can provide low insertion force when both male contact and female contact are matingly engaged with each other and maintain the low insertion force mating relation after long term use of insertion/withdrawal with respect to each other.

Another purpose of the present invention is to provide a new electrical low insertion force mating contact structure having a male contact and a female contact which have a relatively short insertion length therebetween yet still can provide low insertion force with respect to each other.

In accordance with one aspect of the present invention, a mating pair of low insertion force contacts comprises a female contact device and a male contact ready to be engaged with each other. The female contact device comprises a first arm and a second arm insert molded in a dielectric housing. The first arm and the second arm respectively have a first spring contact portion and a second spring contact portion extending out from a front face of the dielectric housing. The first arm has a tail portion extending out from a rear face of the dielectric housing, and the first arm and the second arm are split with each other. A male contact has a slant head connected to two oppositely protruded snaps which are connected to a slant section coplanar with the slant head. The male contact may be engaged with the female contact device by moving the slant head of the male contact into a space between the first spring contact portion and the second spring contact portion and driving the oppositely protruded snaps to respectively wipe against the first spring contact portion and the second spring contact portion.

DETAILED DESCRIPTION OF THE PREFERRED EMBODIMENT

Figure 1:
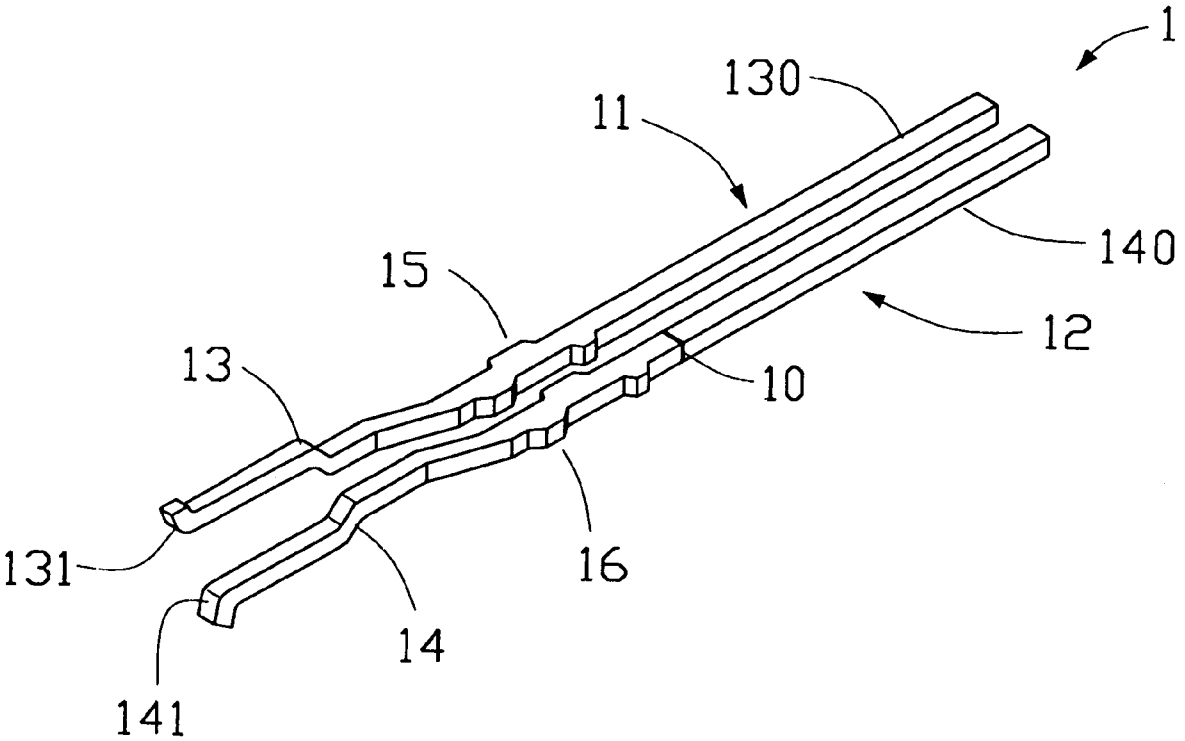
FIG. 1 are two arms constituting a female contact used in the present invention.

Referring to FIG. 1, a female contact means comprises a first arm 11 and a second arm 12. The first arm 11 comprises a tail portion 130, an engagement portion 15 connected to the tail portion 130, and a spring contact portion 13 connected to the engagement portion 15. The spring contact portion 13 is bent upward at an intermediate section thereof, then bent flat for most of the other portion, and finally terminated as a contacting tip 131 which is slightly curved upward.

Similarly, the second arm 12 comprises a tail portion 140, an engagement portion 16 connected to the tail portion 130, and a spring contact portion 14 connected to the engagement portion 16. The spring contact portion 14 is bent downward at an intermediate section thereof, then bent flat for most of the other portion, and finally terminated as a contacting tip 141 which is slightly curved downward.

A deep groove 10 is defined between the tail portion 140 and the engagement portion 16 allowing the tail portion 140 to be torn down from the second arm 12 during a later assembled procedure which will be explained later.

Figure 2:
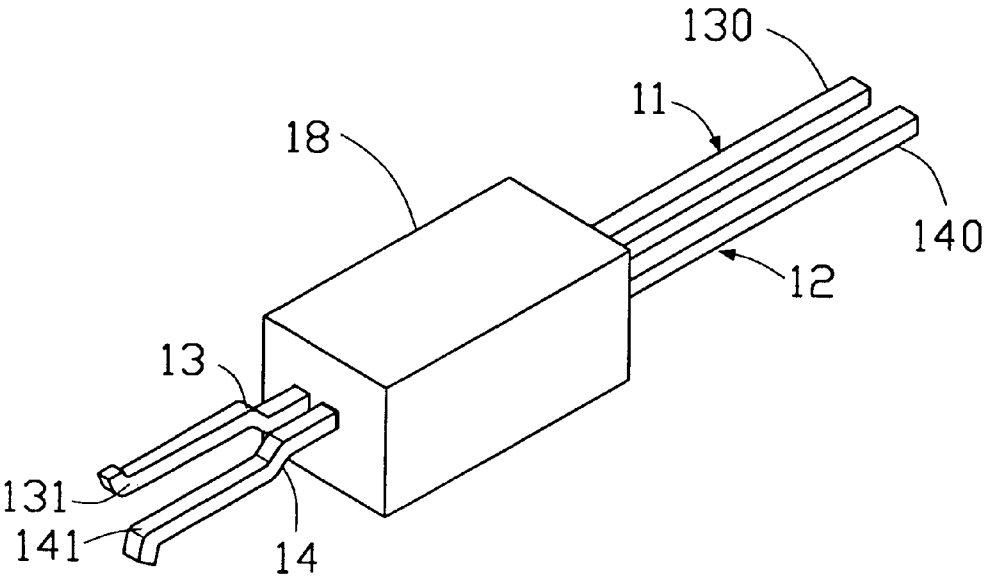
FIG. 2 is an assembled view showing that the arms of FIG. 1 are insert molded in a housing.
Figure 3:
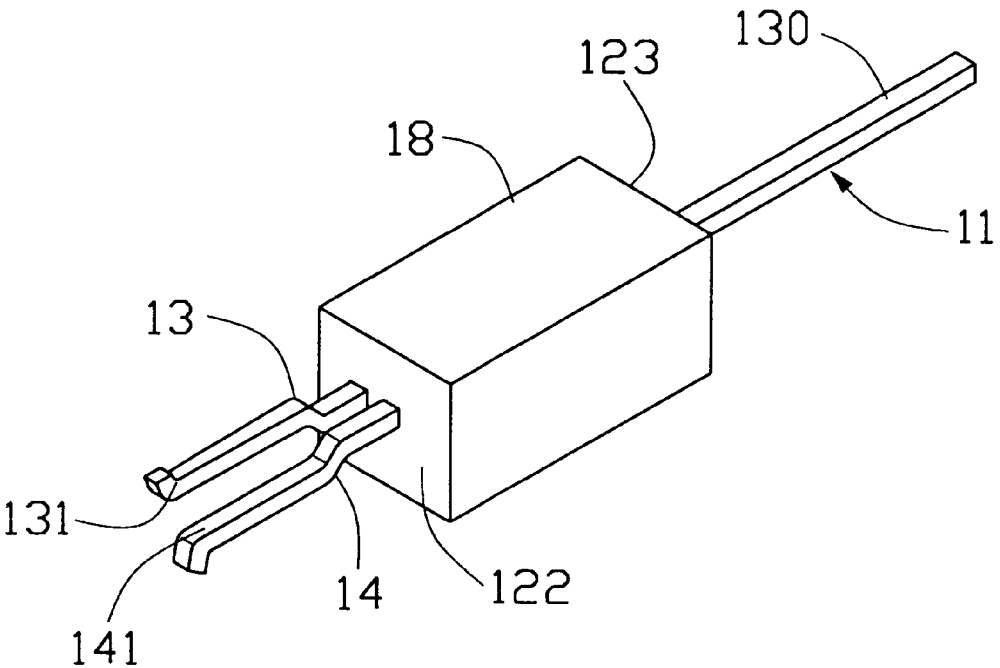
FIG. 3 is a similar view of FIG. 2 except that a tail portion of one arm has been removed.

Referring to FIG. 2, the first arm 11 and the second arm 12 are insert molded in a dielectric housing 18, with the engagement portions 15, 16 being retained in the housing 18 while the tail portions 130, 140 and the spring contact portions 13, 14 extending out of the housing 18, the spring contact portions 13, 14 remaining split with each other. The tail portion 140 of the second arm 12 is then torn down so the female contact 1 has only one tail portion extending from the housing 18 as shown in FIG. 3.

After the above configuration, the female contact 1 has the spring contact portions 13, 14 extending forward from a mating face 122 of the housing 18 and the tail portion 130 extending rearward from a rear face 123 thereof. The split spring contact portions 13, 14 firstly extend from the housing portion 12 in parallel and coplanar in a same horizontal level with each other for a respective section thereof, then offset from each other with respect to the coplanar horizontal level via respective bent sections and finally terminate as diverged contacting tips 131, 141.

Figure 4:
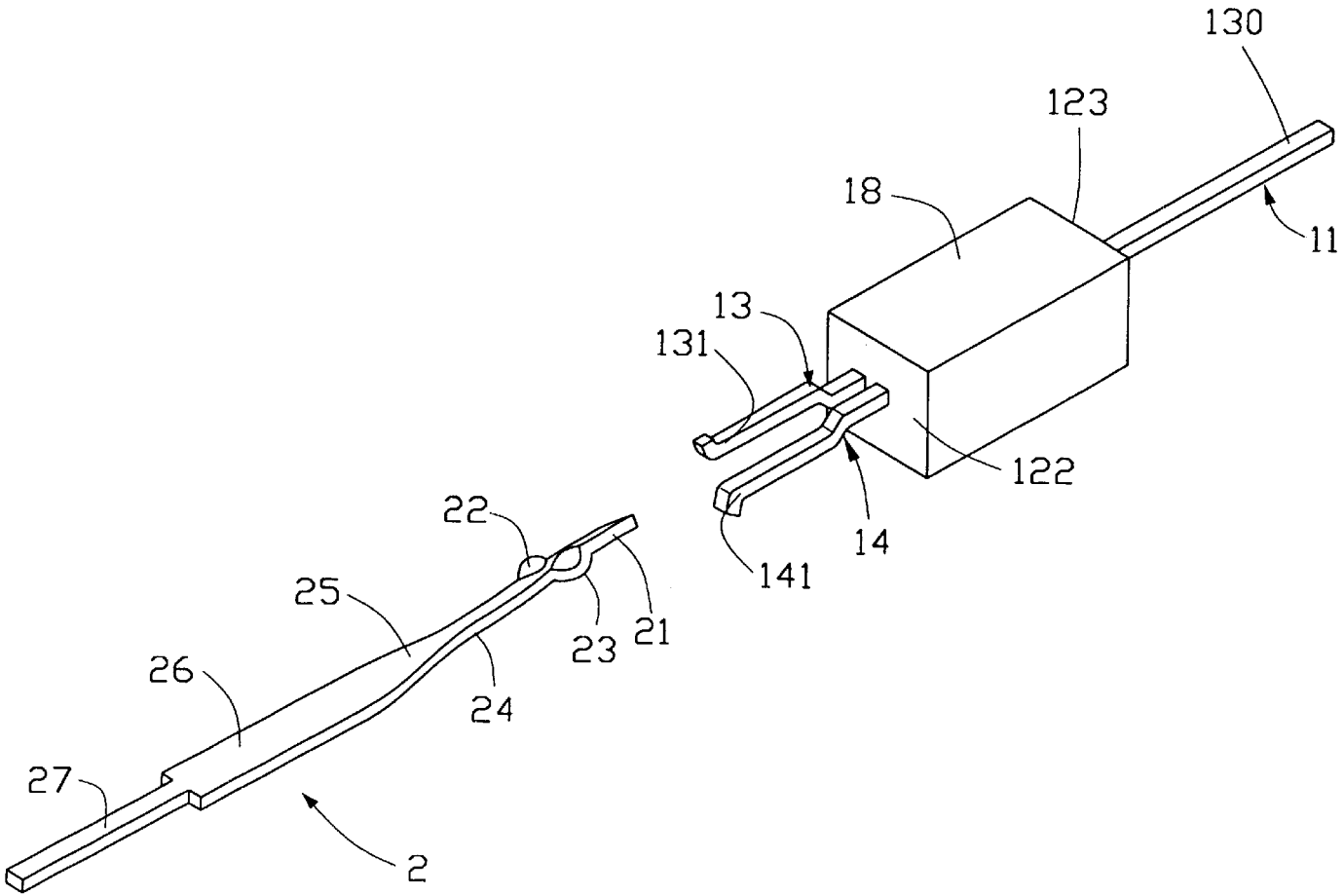
FIG. 4 is a pair of male contact and female contact ready to be engaged to each other in accordance with the present invention.

Referring to FIG. 4, a mating pair of low insertion force contacts in accordance with the present invention comprises the female contact 1 and a male contact 2 ready for engaging with the female contact 1. The male contact 2 has a slant head 21 connected with two snaps 22, 23 which have an identical semispherical shape while protrude oppositely with respect to the virtual slant plane in which the flat head 21 is located. In this embodiment, the semispherical snaps 22, 23 have a same diameter. An intermediate slant section 24 is connected to the snaps 22, 23 at one end thereof and to a twisted section 25 at the other end thereof. The intermediate slant section 24 is coplanar with the slant head 21 and both are located in the virtual slant plane. A flat section 26 is connected between the twisted section 25 and a relatively narrow tail section 27.

Figure 5:
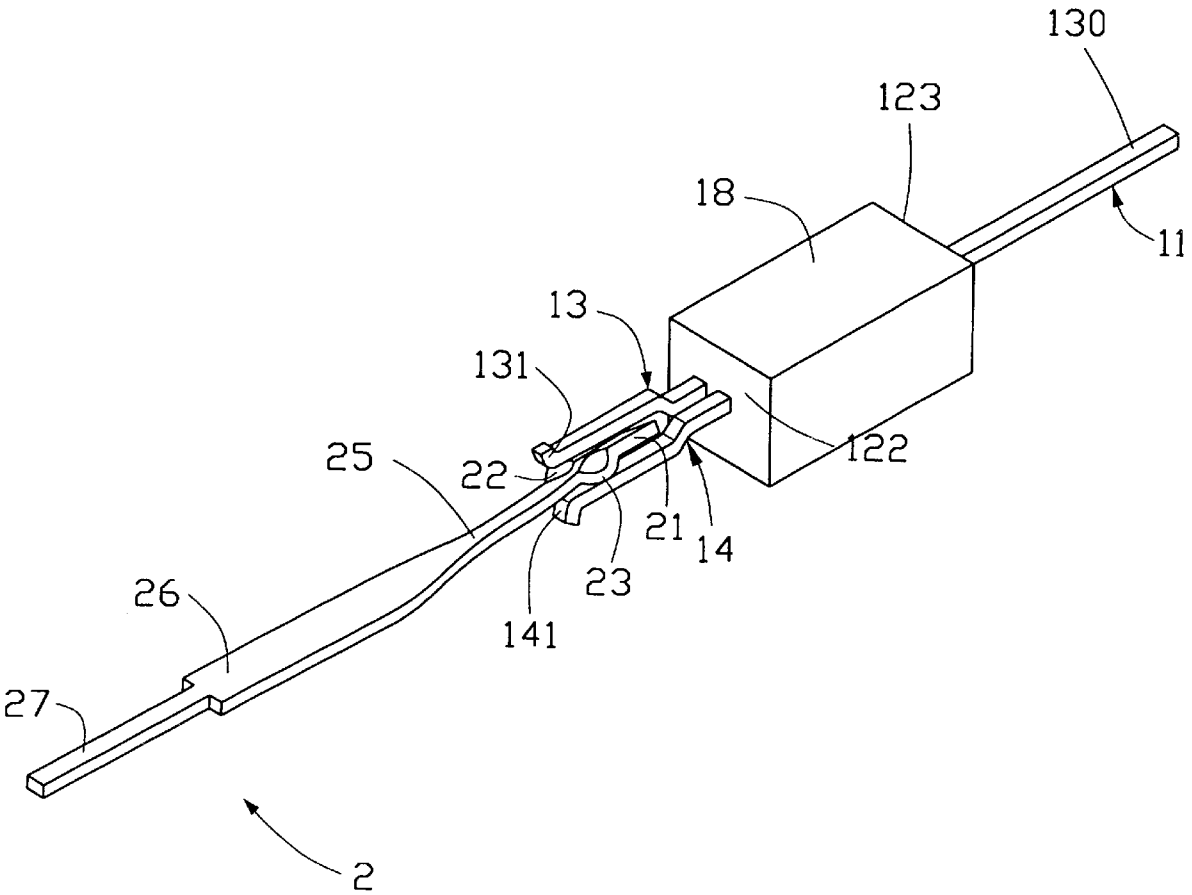
FIG. 5 is a perspective view of the male contact and the female contact of FIG. 4 having been engaged with each other.

Referring to FIG. 5, when the male contact 2 is engaged with the female contact 1, the slant head 21 is firstly moved into a space between the two spring contact portions 13, 14, yet not in contact with either of them, and then the snaps 22, 23 wipe through the diverged contacting tips 131, 141 forcing the spring contact portions 13, 14 to deform for generating tension therein. Therefore, the snaps 22, 23 are maintained in electrical contact with the contacting tips 131, 141 by a normal force exerted from the deformed spring contact portions 13, 14. Since the snaps 22, 23 are formed on the virtual slant plane which is coplanar with the slant head 21 and the intermediate slant section 24, they will wipe through the contact tips 131, 141 gradually and smoothly thereby limiting the wiping resistance to a minimum level, i.e., the insertion force will be limited to minimum. The wiping length of the snaps 22, 23 to the contacting tips 131, 141 is relatively short actually less than a diameter of each contacting snap 22, 23. Precious material coated on the contact tips 131, 141 will not be easily wiped away due to the low wiping resistance and the short wiping length. The normal force of the spring contact portions 13, 14 to the snaps 22, 23 is strong enough to support the required electrical contact because of the elastic force (tension) existed in the deformed spring contact portions 13, 14.

One feature of the invention is to provide the female contact 1 including the first contact portion 13 and the second contact portion 14 spaced from each other for mechanically retaining the intermediate section 24 of the male contact 2 therebetween, while only the first contact portion 13 is electrically connected to the tail portion 130 for connecting to the external connection device, e.g., the circuit board, and the second contact portion 14 essentially only provides mechanical retention function without any electrical function thereof. This alternative may prevent the disadvantage of convention split type female contact that it is difficult in manufacturing the unitary split type female contact, especially when the dimension of the female contact gets smaller. Therefore, in fact only contact portion 13 and its associated tail portion 130 should be deemed as the effective female contact means, and the contact portion 14 is essentially only an auxiliary mechanical support device for holding the male contact without electrical connection function.

Another feature of the invention is that to comply with the diagonal arrangement of the contact portions 13 and 14, the male contact 2 provides an intermediate slant section 24 extending in a reverse diagonal direction wherein the intermediate slant section 24 itself substantially extends plainly without twisting thereof while with a pair of snaps 23, 24 extending in opposite directions therefrom for engagement with the corresponding spring contact portions 13, 14.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A mating pair of low insertion force contacts comprising:

a female contact means comprising a first arm and a second arm insert molded in a dielectric housing, wherein the first arm and the second arm respectively have a first spring contact portion and a second spring contact portion extending out from a front face of the dielectric housing, the first arm has a tail portion extending out from a rear face of the dielectric housing, the first arm and the second arm are spaced from each other, and only the first arm is electrically functional; and a male contact having a slant head connected to two oppositely protruded snaps which are connected to a slant section coplanar with the slant head;

wherein the male contact may be engaged with the female contact means by moving the slant head of the male contact into a space between the first spring contact portion and the second spring contact portion and driving the oppositely protruded snaps to respectively wipe against the first spring contact portion and the second spring contact portion;

wherein the first arm of the female contact means has an engagement portion connected between the first spring contact portion and the tail portion, and the engagement portion is retained in the dielectric housing;

wherein the second arm of the female contact means has an engagement portion connected to the second spring contact portion and retained in the dielectric housing;

wherein the spring contact portion of the first arm of the female contact means is bent upwardly at an intermediate section thereof, then bent flat for most of the other portion, and finally terminated as a contacting tip which is curved upwardly;

wherein the spring contact portion of the second arm of the female contact means is bent downwardly at an intermediate section thereof, then bent flat for most of the other portion, and finally terminated as a contacting tip which is curved downwardly;

wherein the snaps have an identical semispherical shape.

* * * * *